US009494392B2

(12) United States Patent
Hoetger

(10) Patent No.: US 9,494,392 B2
(45) Date of Patent: Nov. 15, 2016

(54) SHOOTING TARGET APPARATUS

(71) Applicant: Ralph Hoetger, Idyllwild, CA (US)

(72) Inventor: Ralph Hoetger, Idyllwild, CA (US)

( * ) Notice: Subject to any disclaimer, the term of this patent is extended or adjusted under 35 U.S.C. 154(b) by 0 days.

(21) Appl. No.: 15/177,030

(22) Filed: Jun. 8, 2016

(65) Prior Publication Data

US 2016/0282090 A1 Sep. 29, 2016

Related U.S. Application Data

(63) Continuation-in-part of application No. 14/533,447, filed on Nov. 5, 2014, now Pat. No. 9,389,049, and a continuation-in-part of application No. 29/541,642, filed on Oct. 6, 2015.

(51) Int. Cl.
*F41J 5/24* (2006.01)
*F41J 1/10* (2006.01)

(52) U.S. Cl.
CPC .... *F41J 5/24* (2013.01); *F41J 1/10* (2013.01)

(58) Field of Classification Search
CPC ..... F41J 9/26; F41J 5/24
USPC ..... 273/348, 378, 380, 383; 446/186, 187, 446/220, 224
See application file for complete search history.

*Primary Examiner* — Gene Kim
*Assistant Examiner* — Rayshun Peng
(74) *Attorney, Agent, or Firm* — Clement Cheng

(57) ABSTRACT

A shooting target apparatus has a base, a body connected to the base, and an inlet valve connected to the body, adapted for connection to a source of pressurized fluid. The first valve provides for a one-way intake of fluid. A socket is formed on the body, in which the socket is formed as a threaded adapter having sidewalls and the threaded adapter has an adapter upper surface. A seal mounted to the adapter upper surface, a surface in which the body and the seal include a pathway therein formed to channel fluid between the first valve and the seal, the threaded adapter being shaped and configured to removably receive a target.

15 Claims, 13 Drawing Sheets

SHOOTING TARGET APPARATUS

CROSS-REFERENCE TO RELATED APPLICATION

This non-provisional patent application is a continuation in part of and claims priority to co-pending United States non-provisional utility patent application Ser. No. 14/533,447 filed Nov. 5, 2014 by inventor Ralph HOETGER, entitled Shooting Target Apparatus, which in turn claims priority to U.S. Provisional Application Ser. No. 61/963,084, filed on 22 Nov. 2013, both of which are incorporated herein by reference. This non-provisional patent application also a continuation in part of and claims priority to co-pending U.S. design patent application Ser. No. 29/541,642 filed Oct. 6, 2015 by inventor Ralph HOETGER, the disclosure of which is incorporated herein by reference.

FIELD OF THE APPARATUS

This apparatus relates generally to shooting target systems that provide an easy setup of targets for shooting practice using common containers, and more particularly to systems that provide a means of immediate feedback by visual, or auditory indications, or both.

DISCUSSION OF RELATED ART

There have been numerous targeting apparatuses invented for indicating accurate impact. Such targets are intended for use in testing ones skill in shooting some type of projectile. More particularly, devices are designed for use in target practice with a gun which fires bullets, an air gun which shoots pellets, or a bow which shoots arrows, all for the purpose of testing one's accuracy.

There are existing apparatuses intended for the above-mentioned general purposes. When a shooter is positioned at a substantial distance from conventional targets of the bull's eye type, or any other similar known target, it can be difficult to tell exactly whether or where one's bullet or arrow has hit the target.

One area of effort to overcome the above-mentioned problem has been the use of various optical devices, such as telescopes, binoculars, spotting scopes, or the like, so that one can view the target very carefully front the target shooting location for the purpose of attempting to determine precisely where the previously fired projectile has impacted the target. Under such field target shooting conditions, target shooters may set up cans or bottles rather than use conventional bull's eye-type paperboard or cardboard targets primarily because of the previous deficiency. Not immediately knowing the results of a shot is, of course, not true when one shoots at bottles, cans, or the like, where the impact of the fired projectile will be immediately perceptible to the shooter, either because the hit bottle shatters or the hit can is caused to fly from its previous at rest location, or it emits a loud sound when it is shot by a bullet. Either way, such a physical target in some way produces a visible indication to the shooter that the shot has hit the intended target, or, conversely, has missed it. That is the primary reason why such casual field target shooters frequently shoot at bottles, cans, electric power wire insulators, and other objects which will give of a visible indication when hit by a bullet.

SUMMARY OF THE INVENTION

A purpose of the invention is to provide an inexpensive target apparatus which provides a user visual or audible, or both, indication when the target is hit. An embodiment of the shooting target system includes setting up pressurized containers as targets in shooting ranges. When the pressurized container, such as a bottle, is hit by a pellet, bullet, or arrow, it is popped with a sound of a small explosion, providing an excitement in the shooting experience. The bottle may also be partially filled with water or a powder-like substance to create a visual effect of an explosion when the target is hit. The bottle is typically mounted onto a nipple or threaded receiver on the shooting target system. To pressurize the bottle, the bottle is mounted onto a nipple on the shooting target system. Then pressurized air is connected to a valve or an inlet opening in the target system. When the pressure in the bottle reaches a predetermined level, the target system with the bottle is set up as a target for shooting.

A shooting target apparatus has a base, a body connected to the base, and an inlet valve connected to the body, adapted for connection to a source of pressurized fluid. The first valve provides for a one-way intake of fluid. A socket is formed on the body, in which the socket is formed as a threaded adapter having sidewalls and the threaded adapter has an adapter upper surface. A seal mounted to the adapter upper surface, a surface in which the body and the seal include a pathway therein formed to channel fluid between the first valve and the seal, the threaded adapter being shaped and configured to removably receive a target.

A first target holder is attached to the body, where the first target holder is configured to selectively engage a target, where the first target holder is a threaded adapter first section. A second target holder is attached to the body, in which the second target holder is configured to selectively engage a target, where the second target holder is a threaded adapter second section. And a first adapter slot and a second adapter slot form on a threaded adapter portion of the first target holder, where the first adapter slot opposes the second adapter slot, while the first adapter slot and the second adapter slot extend from an adapter upper rim downward to define a threaded adapter first section and a threaded adapter second section, in which threads of the threaded adapter are discontinuous.

Preferably, the shooting target apparatus has a threaded adapter that has an adapter lower surface and the inlet valve is mounted to an adapter lower surface, while the inlet valve is formed with a valve stem. The shooting target apparatus, in which the adapter lower surface is formed inside a valve stem access slot, contains a valve stem access slot, which is formed between a pair of valve stem access slot walls, where the valve stem access slot further defines a front access slot tip and a rear access slot tip extending downwardly from the valve stem access slot. The shooting target apparatus has a valve stem access slot, which also has a front access slot overhang and a rear access slot overhang.

Additionally, the shooting target apparatus has a valve stem secured to the adapter lower surface by a valve nut and a valve stem mounted between the pair of valve stem access slot walls. The shooting target apparatus, in which the adapter lower surface has an adapter base depression formed between the threaded adapter first section and the threaded adapter second section, has an adapter-based depression formed between the first adapter slot and the second adapter slot.

The shooting target apparatus, where the front access slot tip and the rear access slot tip are configured to support the shooting target apparatus, and where the front access slot tip has a front access slot tip right corner and a front access slot tip left corner, has a rear access slot tip, a rear access slot tip right corner, and a rear access slot tip left corner, where the front access slot tip right corner, the front access slot tip left corner, the rear access slot tip right corner, and the rear access slot tip left corner are all configured to support the shooting target apparatus by extending downwardly from the body.

BRIEF DESCRIPTION OF THE DRAWINGS

Various objects, features, and attendant advantages of the present invention will become more fully appreciated as the same becomes better understood when considered in conjunction with the accompanying drawings.

The following call out list of elements can be a useful guide in referencing the elements of the drawings.

100 Shooting Target Apparatus
110 Base
111 Outside Base Edge
112 Inside Base Edge
120 Body
130 Target
140 Target Holder
150 Arms
160 First Valve
170 Second Valve
210 Nipple
220 Annular Bead
230 Bottle Opening
410 Threaded Portions
420 Threaded Nuts
430 Elbows
440 Slot
450 Target Holder With Narrow Slot
455 Proximal Wing
460 Narrow Slot
465 Distal Wing
510 Port
515 Nipple
550 Pressure Gauge
560 Internal Pathway
610 Guard
710 Bottle
800 Apparatus
11 Cylindrical Head
12 Threaded Adapter
13 Adapter First Slot
14 Adapter Second Slot
15 Adapter Plot Corner Tip
16 Adapter Slot Rounded Profile
17 Adapter Inside Bevel
18 Adapter Outside Bevel
19 Adapter Upper Rim
20 Adapter Base Depression
21 Inset Valve Stem
22 Valve Stem Lower Protrusion
23 Valve Stem Access Slot
24 Valve Stem Access Slot Wall
25 Valve Stem Access Slot Edge
26 Adapter Lower Surface
27 Valve Nut
28 Valve Stem
30 Valve Stem Wrench Tool
31 Valve Stem Wrench Tool Prong
32 Valve Stem Wrench Tool Slot
33 Adapter Upper Surface
34 Front Access Slot Tip
35 Rear Access Slot Tip
36 Front Access Slot Overhang
37 Rear Access Slot Overhang
38 Threaded Adapter First Section
39 Threaded Adapter Second Section
40 Tapered Plug
41 Outer Taper
42 Plug Opening
43 Air Passage
44 Air Duct
45 Tube Extension
46 Cylindrical Head Height
50 O-Ring Seal
51 O-Ring Annular Groove
52 Valve Stem Thread
53 Base Connection Notch
54 Front Access Slot Tip Right Corner
55 Front Access Slot Tip Left Corner
56 Rear Access Slot Tip Right Corner
57 Rear Access Slot Tip Left Corner

DETAILED DESCRIPTION OF EMBODIMENTS OF THE INVENTION

Reference will now be made in detail to various exemplary embodiments of the invention. The following description is presented for the purpose of describing certain embodiments in detail. The apparatus is further illustrated in the accompanying drawing figures, attention being called to the fact, however, that the embodiments described and shown are illustrative only and are not intended to limit the scope of the concept. Changes may be made in the specific constructions disclosed herein that a person of ordinary skill in the art will recognize are within the scope and spirit of the described concept. Further, any features of any embodiment described herein are equally applicable to any other embodiment described herein or envisioned by one of ordinary skill in the art. The detailed description and figures provided herein should not be construed to exclude features otherwise described with respect to another embodiment.

Figure 1:
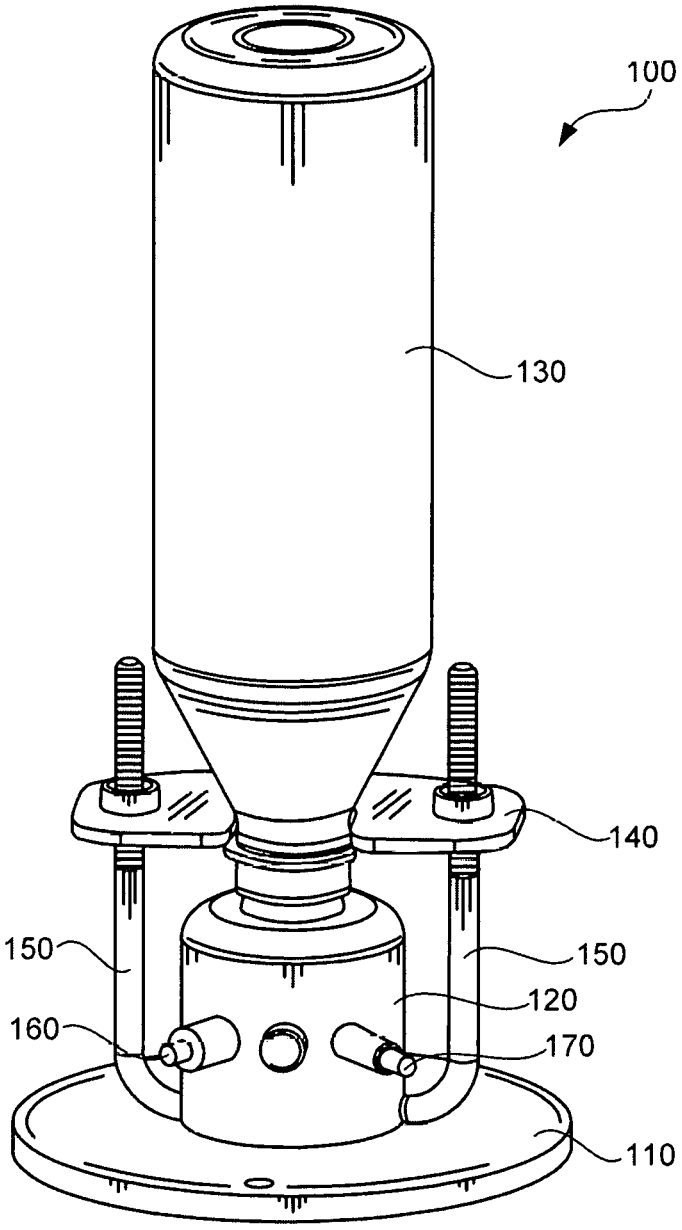
FIG. 1 is a front perspective view of a shooting target apparatus according to at least one aspect of the invention.
Figure 2:
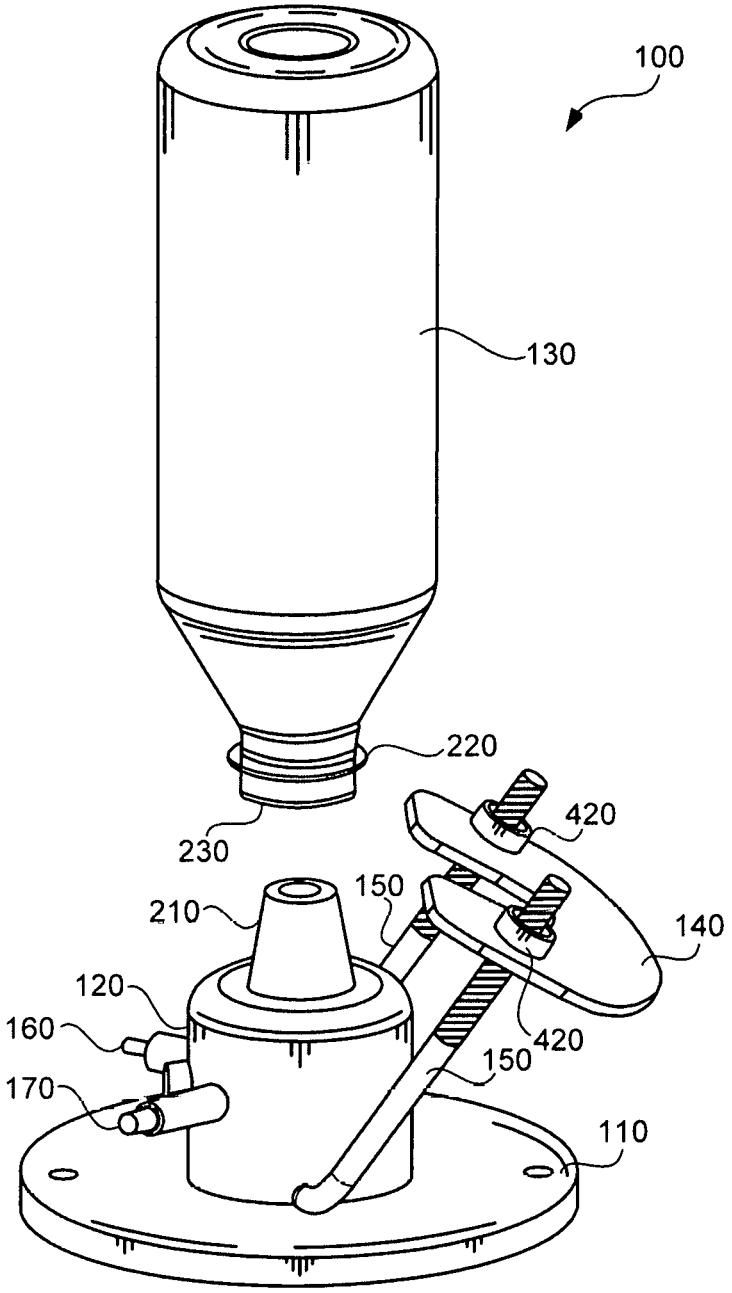
FIG. 2 is a side perspective view of the FIG. 1 apparatus with the target disengaged.
Figure 4:
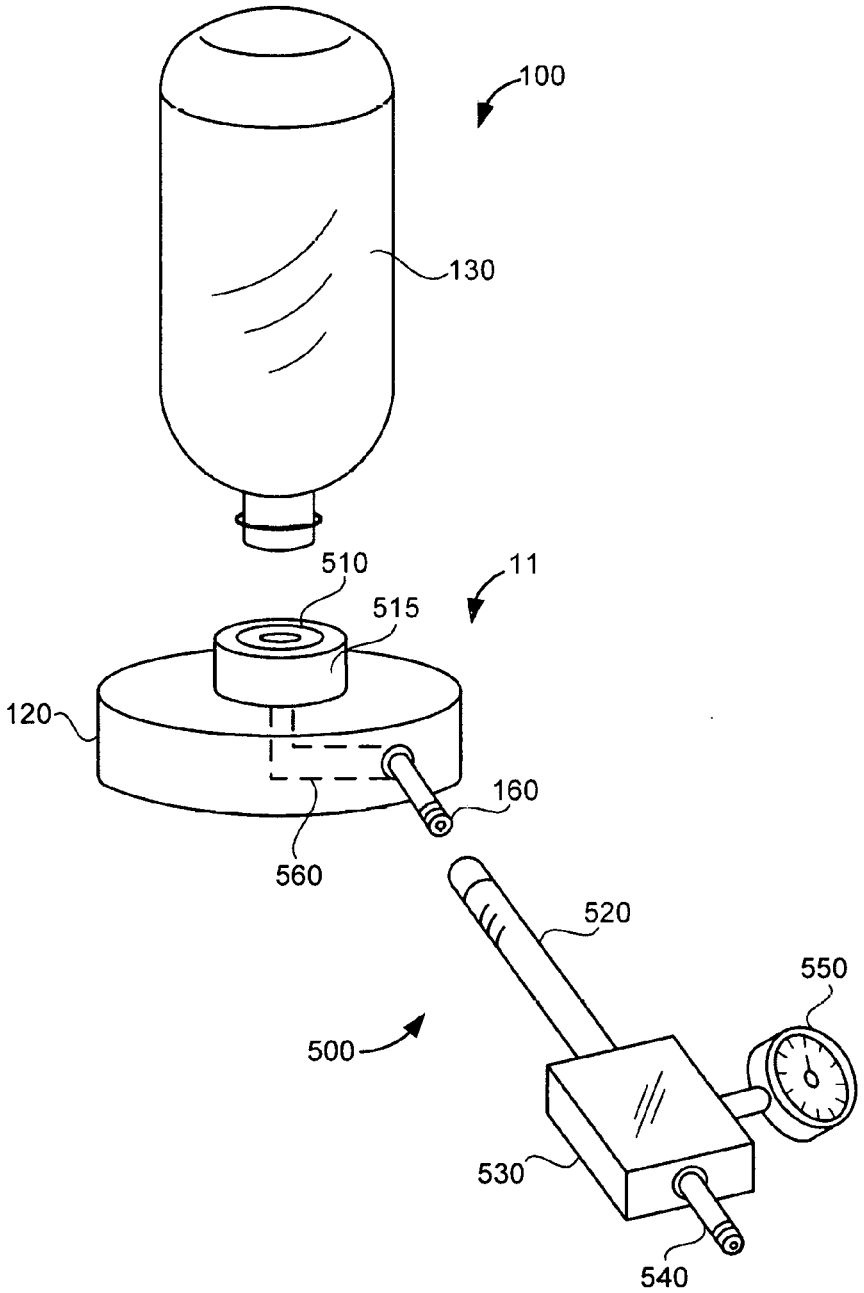
FIG. 4 is an exploded perspective view of alternative embodiment with an injector assembly.

Referring now to the drawing and more particularly to FIGS. 1 and 2, an embodiment of shooting target apparatus 100 is depicted. The shooting target apparatus includes base 110, body 120, nipple 210, and target holder 140. Target 130 is a replaceable container that is removably connected to the apparatus. The replaceable container can be an empty plastic beverage bottle. The target may be threaded, clamped, or otherwise mounted onto the apparatus. Base 110 is formed as a disk connected to the body 120 for stabilizing the apparatus. It may be bolted to a substrate or may be heavy enough to support the apparatus on the ground or on a bale of hay, for example. The body, which includes the nipple, is attached to the base or it may be integrally formed with the base. The nipple and the base include an internal pathway 560, as shown in FIG. 4, to channel pressurized fluid, such as air. This is connected to first valve 160 which is adapted to be connected to a source of pressurized air. For the purposes of this description, the word "air" may be used interchangeably with any gas or liquid employed for added pressure purposes. After target 130 is securely mounted to nipple 210, pressurized air from a conventional source is connected to valve 160 to pressurize the target through the internal pathway. Target holder 140 is rotatably coupled to the body and provides a means for securing the target to the body.

Target 130 is a frangible container and is referred to herein as a bottle. The container may be plastic and provides visual impression upon being hit by a projectile of exploding when it is internally pressurized. The target could also be a bag, preferably having a defined volume. Such a bag would have an opening to receive pressurized air, in which the opening is adapted with a nipple or equivalent coupling on the body, with appropriate means to seal and hold the pressurized bag to the body. Such means could include a clamp, a band, or a string to tie the bag opening to the body. The body may alternatively include a check valve to prevent air backflow, although first valve 160 can provide that function. There may be a second valve 170 which allows the release of air and can act as a relief valve. When there are two valves, the first valve 160 allows for the intake of air whereas the second valve allows for the release of air. The first and second valves may be conventional bicycle or vehicle tire valves. Further, the first and second valves are typically one-way valves to allow for the passage of air and to prevent the backflow of the air.

Figure 3:
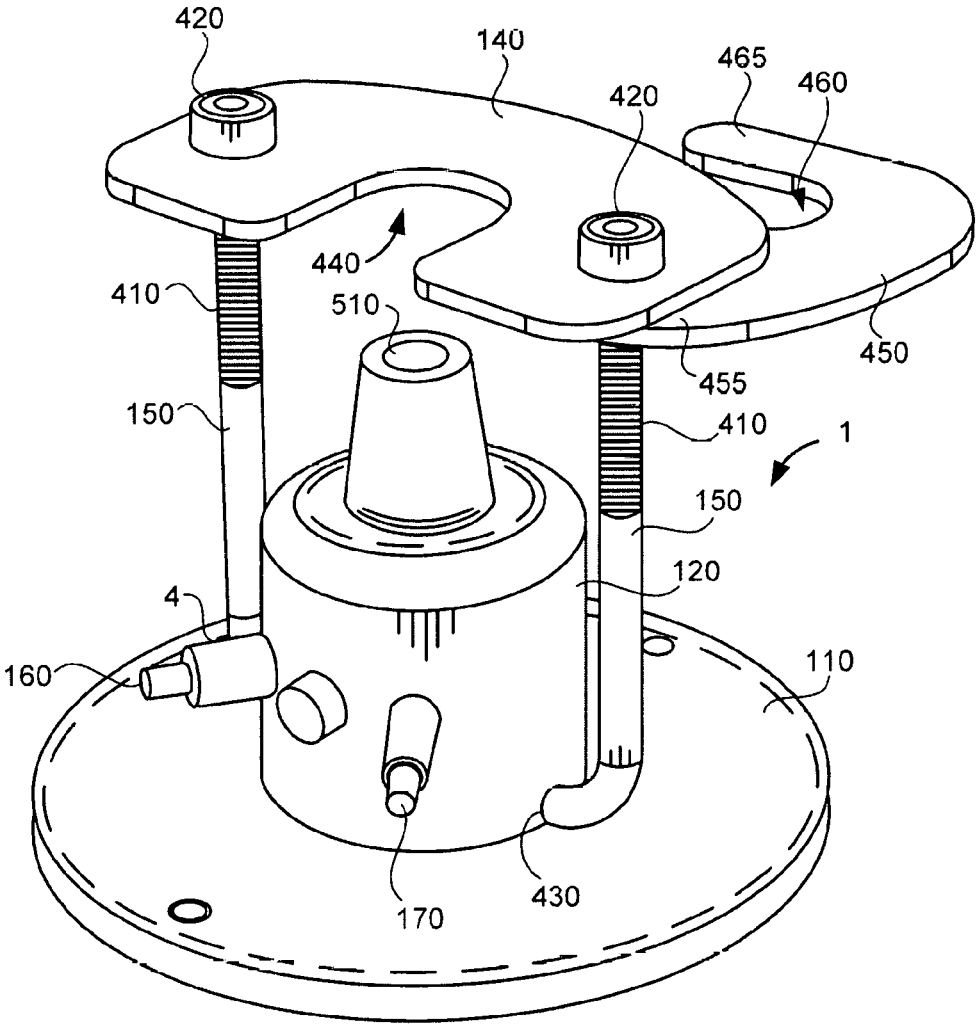
FIG. 3 is a perspective view of the apparatus of FIG. 1 without the target, and includes an alternative embodiment.

Body 120 may have a port 510 as shown in FIG. 3. The word "port" applies to the hole in nipple 210 for the purposes of this description. First, valve 160 receives air injected into the body and the air moves out to the port. The port receives the bottle while the bottle is pressurized and set up as a shooting target. As an alternative example, a check valve may be built into the body to prevent reverse airflow. This kind of valve is commonly used in bicycle tubes. Also, it can be a simple check valve allowing the airflow in one direction only. The body simply directs the airflow from the first valve to port 510 by means of a pathway, which may be pathway 560 in FIG. 3.

Referring to FIG. 2, target 130 is shown separated from nipple 210, and target holder 140 is disengaged. The nipple and the target holder hold the target while the target is pressurized and set as a target. The target holder has a slot 440, as shown in FIG. 3, which is configured to partially surround the neck area of the bottle. Bottles which are contemplated to be used as targets in this system are typically formed with a flange or annular bead 220 near the neck opening. The slot engages the neck part of the bottle just above (when the bottle is inverted) the annular bead 220. The opening of the slot is smaller than the diameter of the flange so when the target holder is engaged with the bottle, the bottle is locked on the nipple. The nipple is preferably sloped or conical so that when the bottle is inserted on to it, the nipple acts as a plug, sealing the rim of bottle opening 230 by engaging an inside surface of the rim of the bottle opening 230. The target holder is then screwed down with threaded nuts 420 on the threaded portions 410 of arms 150, as shown in FIG. 3, to create and maintain an air tight seal with the bottle opening. The target holder is supported by arms 150 which can pivot about the body. FIG. 1 shows the bottle locked on the nipple with the target holder engaged on the neck part of the bottle. The length of the arms between target holder and pivot can be adjusted to fit any particular bottle.

As an alternative, a powder or fine granular material can be added within the target to enhance the visual evidence that the target has been struck by a projectile. The visual effect can be accentuated if the powder or granular material is colored.

Referring to FIG. 3, target holder 140 is in its upright, engaged position. The target holder arms pivot at elbows 430 on each side of body 120. When the arms pivot together to an upright position, the holder, which is located at the distal ends of arms 150, is in a position for slot 440 to slide onto the neck of the bottle, as shown in FIG. 1.

An alternative embodiment is also shown in FIG. 3, where small bottle adapter target holder 450 is optionally included with the FIGS. 1 and 2 embodiments. This is to enable the apparatus to accommodate bottles that have smaller necks than the bottle shown in FIGS. 1 and 2. Target holder 140 has slot 440 of what may be considered average size bottles. Target holder 450 has a narrower slot 460 to fit bottles having necks with a smaller diameter than the neck of target 130 shown in FIGS. 1 and 2.

Target holder 450 pivots laterally on one arm 150 on its proximal wing 455. Target holder 450 is smaller than is target holder 140 so that distal wing 465 does not engage with or encounter the opposite arm 150 when target holder 450 is pivoted into operative position to engage a bottle. Because target holder 450 is under target holder 140, threaded nuts 420 function to clamp a target bottle having a smaller-neck in place in the same manner as target holder 140 clamps a larger-neck bottle.

A simplified embodiment is shown in the exploded perspective view of FIG. 4. Injector assembly 500 attaches to first valve 160 to indicate the pressure in target 130 and to inform the operator in order to prevent premature explosion. An injector assembly includes manifold 530, inject tube 520, pressure gauge 550, and second valve 540. The manifold has air channels inside connecting parts as appropriate. The second valve is to receive airflow from a source of pressurized air. The second valve is also one-way to allow airflow into the manifold and to prevent airflow in the reverse direction. The air flows out from the manifold through the inject tube, which is attached to a second area of the manifold. The distal end of the inject tube has a fitting to engage first valve 160 to direct airflow from the manifold to the first valve. The pressure gauge measures and displays air pressure in the target. As shown, the threads at the opening of bottle 130 may be engaged with mating threads in port 510 of nipple 515 in this embodiment.

Figure 5:
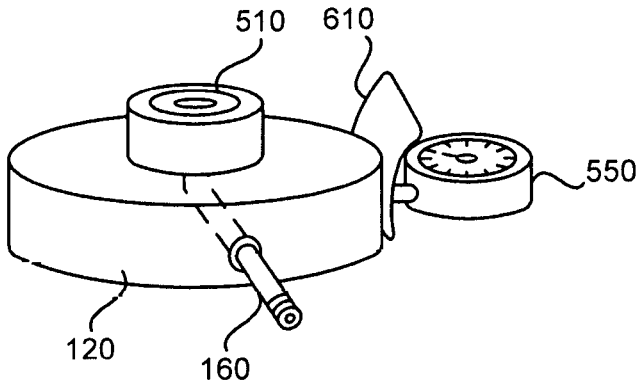
FIG. 5 is a perspective view of the base of FIG. 4 with a gauge and a gauge guard.

FIG. 5 depicts another alternative embodiment of the apparatus, similar to the FIG. 4 embodiment, including pressure gauge 550 which directly attaches to body 120 to measure and display the pressure inside the target bottle. A guard 610 is attached to the pressure gauge to protect the gauge from the projectiles fired by the user.

Figure 6:
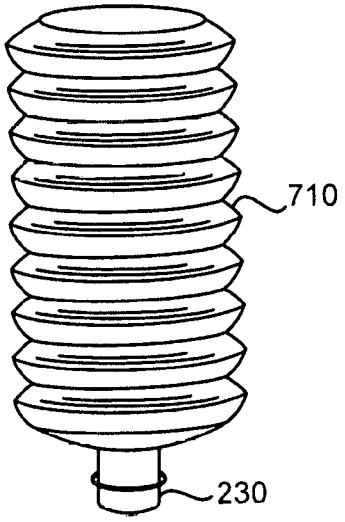
FIG. 6 is a perspective view of an alternative target.

FIG. 6 shows an alternative embodiment of a target bottle. In this example, bottle 710 has a bellows or accordion style configuration which can be compressed for handling and expands as it is pressurized. The bottle has opening 230 which is formed with internal or external threads that can be screwed onto the port, which would be formed with mating threads to receive the bottle. When the bottle is compressed, it will take the form of a circular puck-like object. When pressurized air is thread into the bottle, it will expand until it forms a full-sized bottle. The bottle retains the full-sized bottle shape while it is internally pressurized.

Figure 7:
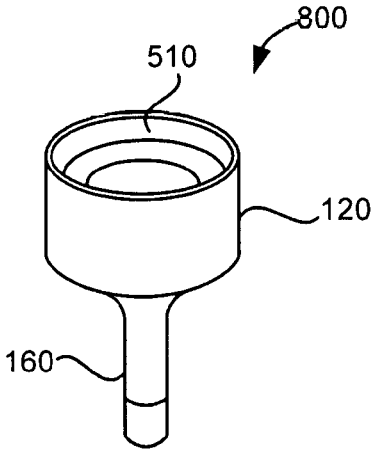
FIG. 7 is a perspective view of a simplified version of an alternative connector using a threaded can with an O-ring without the target.
Figure 8:
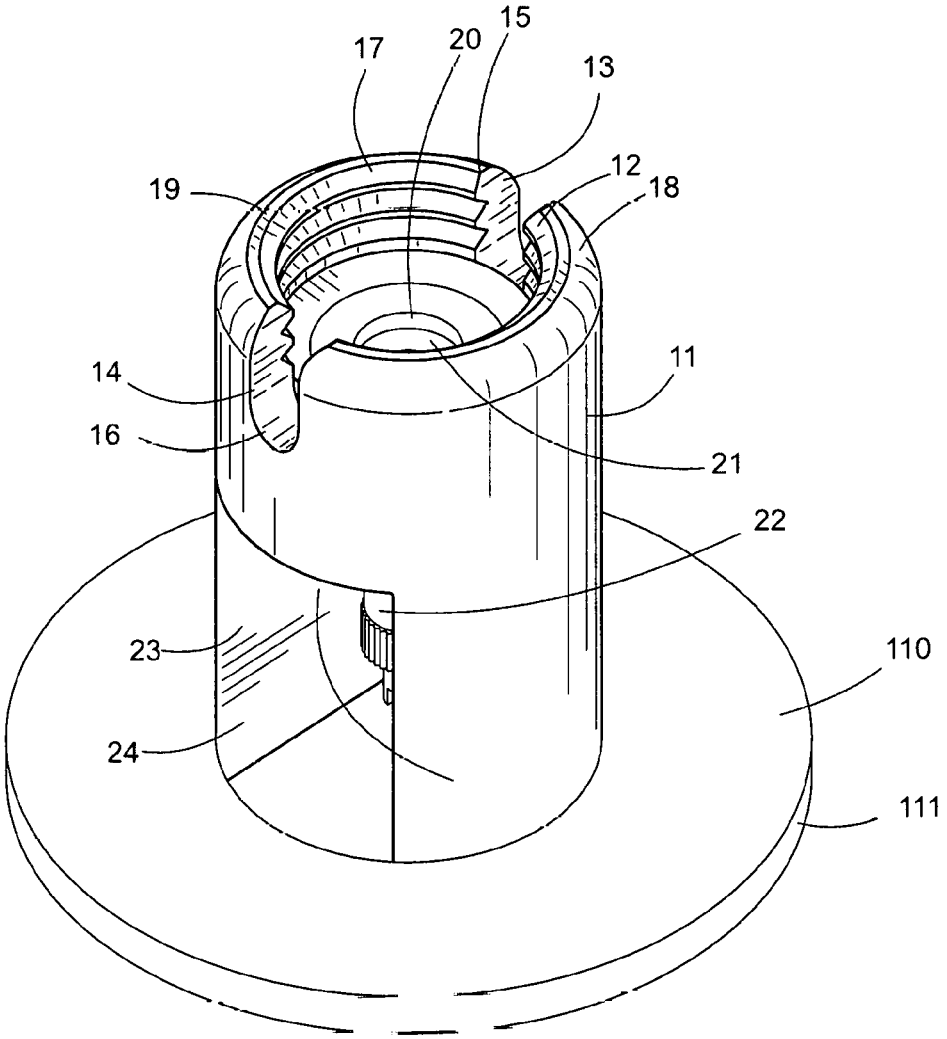
FIG. 8 is a perspective view of the present invention.
Figure 9:
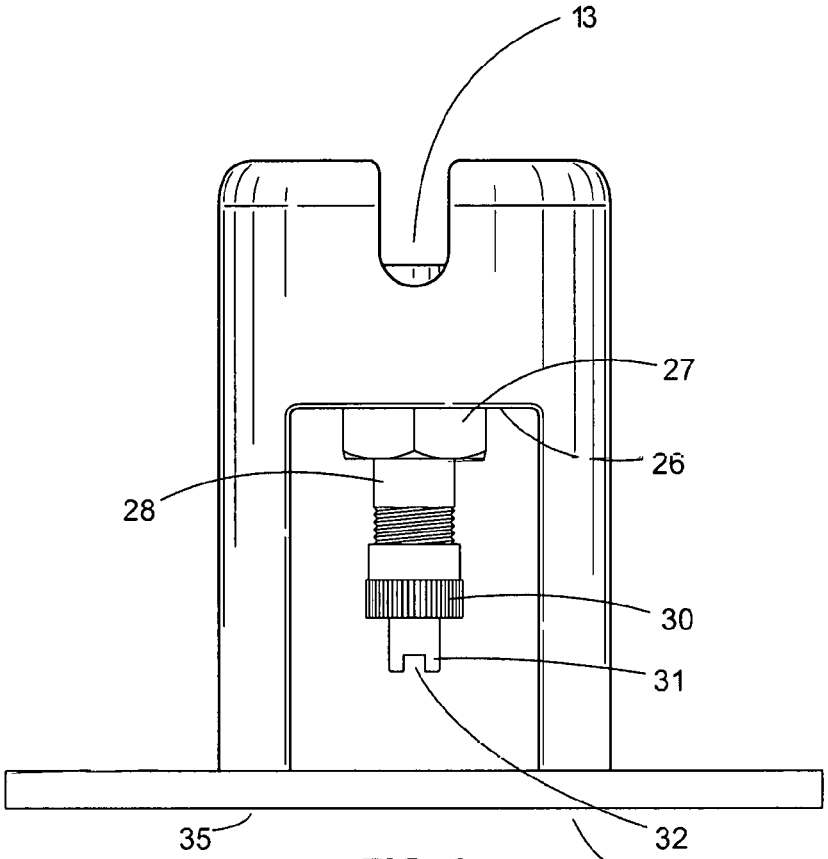
FIG. 9 is a front view of the present invention.
Figure 10:
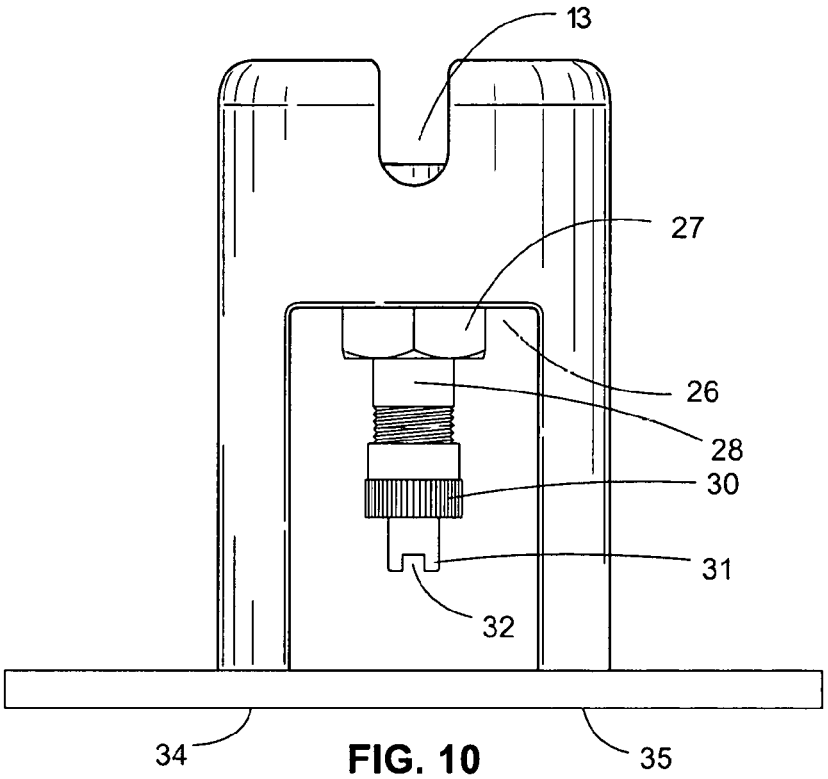
FIG. 10 is a rear view of the present invention.
Figure 11:
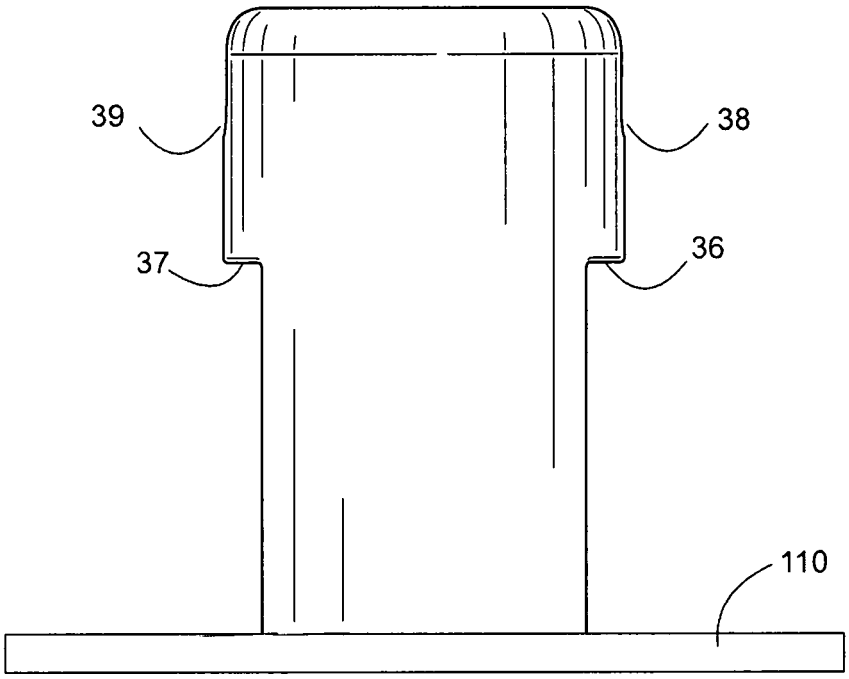
FIG. 11 is a left side view of the present invention.
Figure 12:
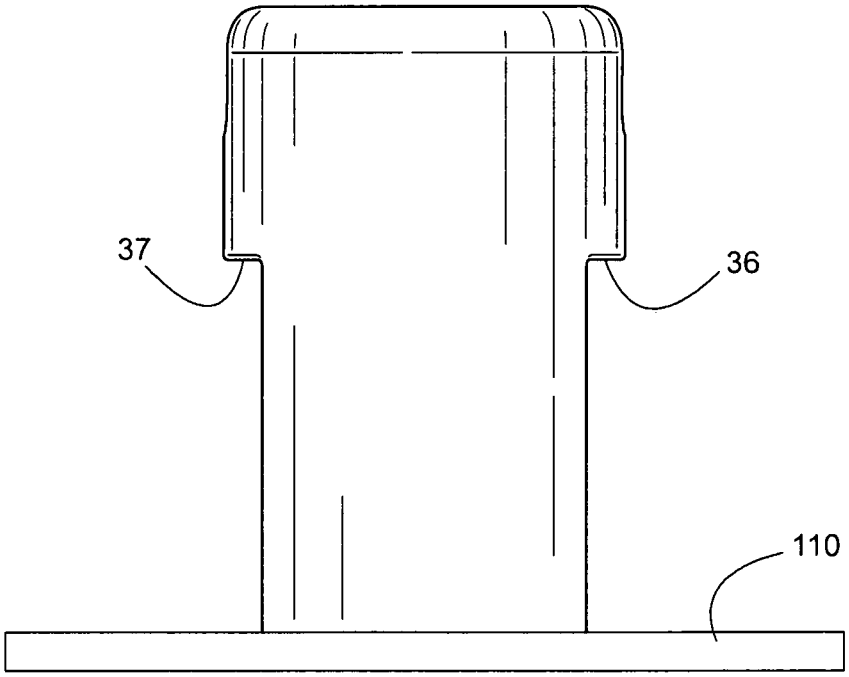
FIG. 12 is a right side view of the present invention.
Figure 13:
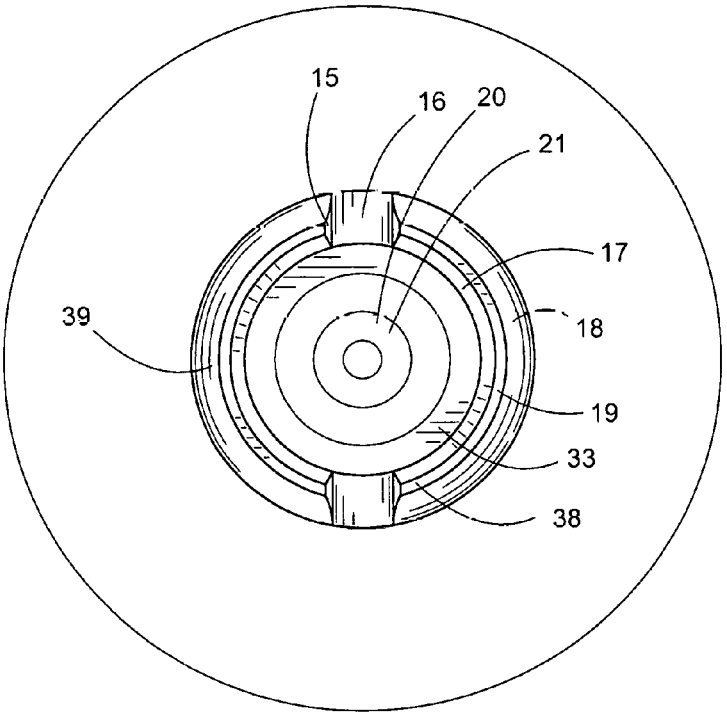
FIG. 13 is a top view of the present invention.
Figure 14:
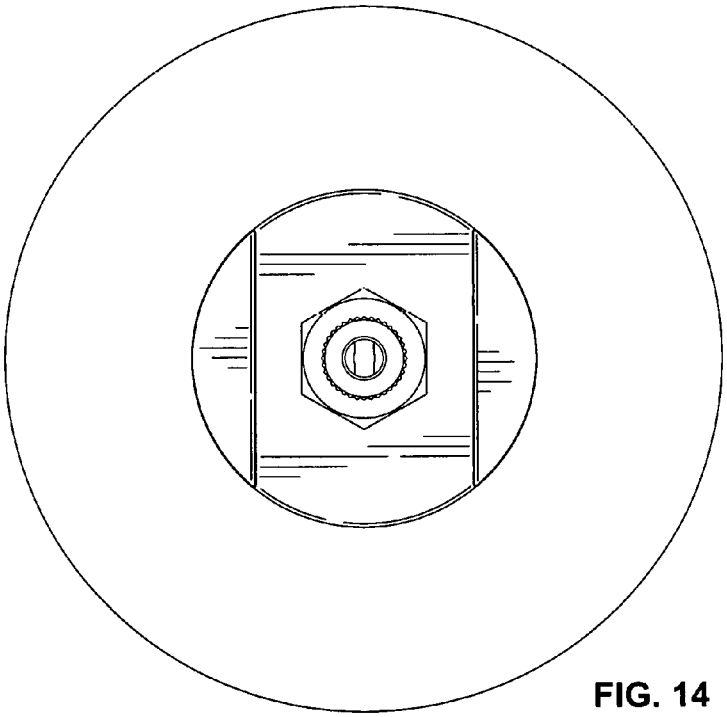
FIG. 14 is a bottom view of the present invention.
Figure 15:
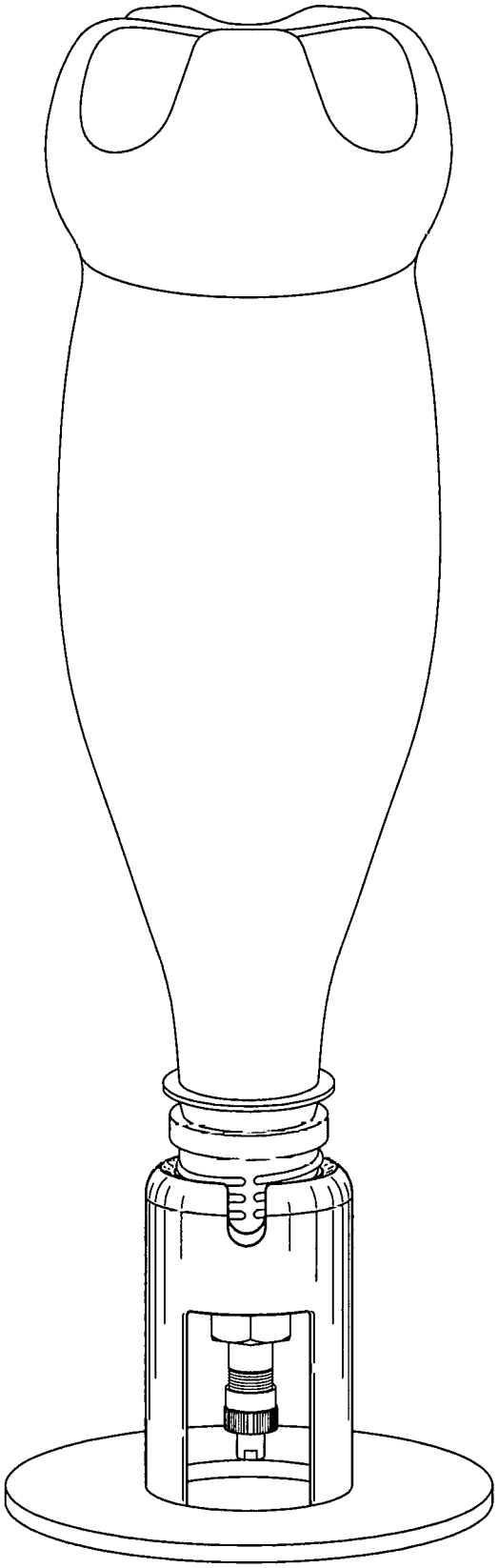
FIG. 15 is a perspective view of the present invention.
Figure 16:
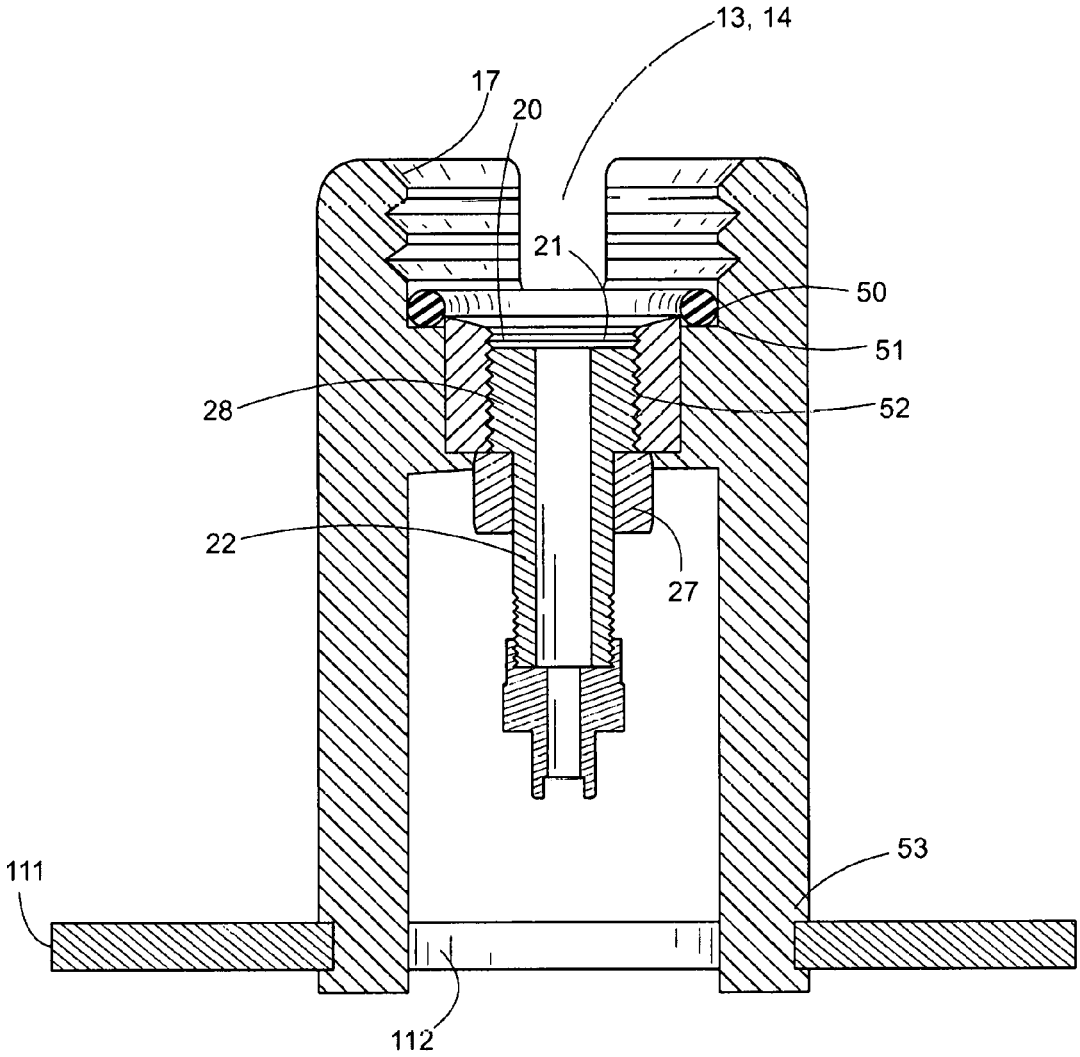
FIG. 16 is a cross-section view of the present invention with an O-ring seal.
Figure 17:
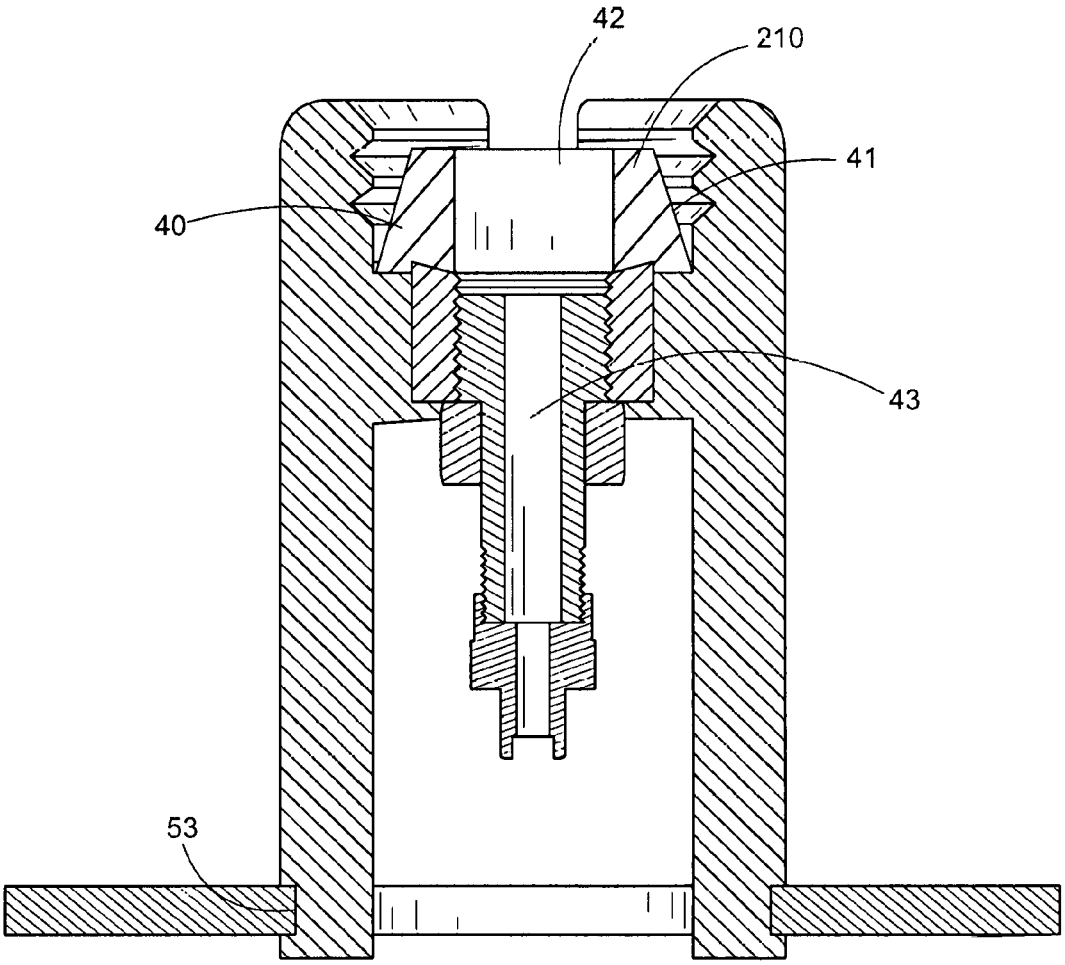
FIG. 17 is a cross-section view of the present invention with a tapered O-ring seal.
Figure 18:
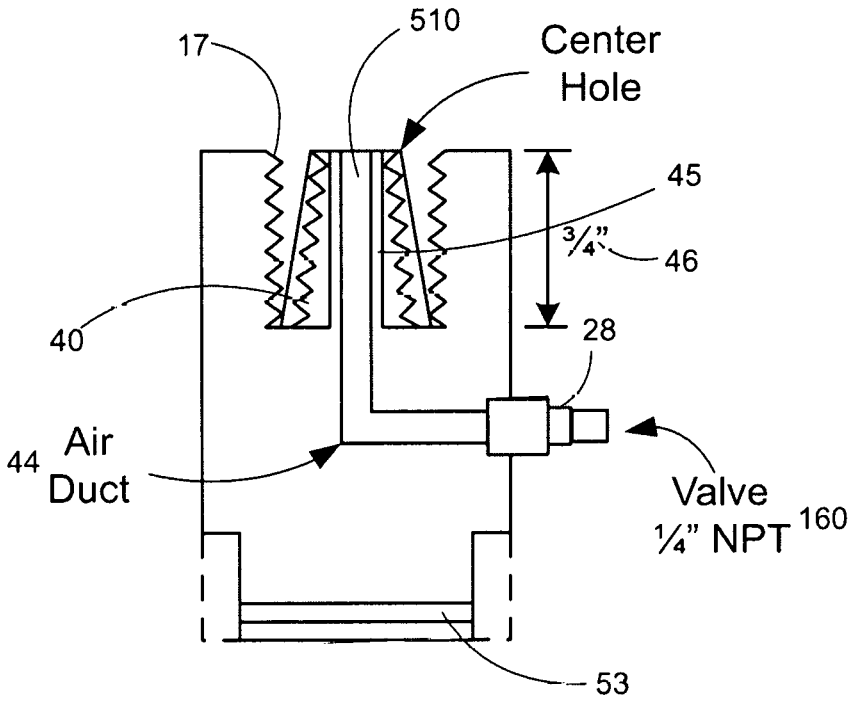
FIG. 18 is a cross-section diagram of the present invention.
Figure 19:
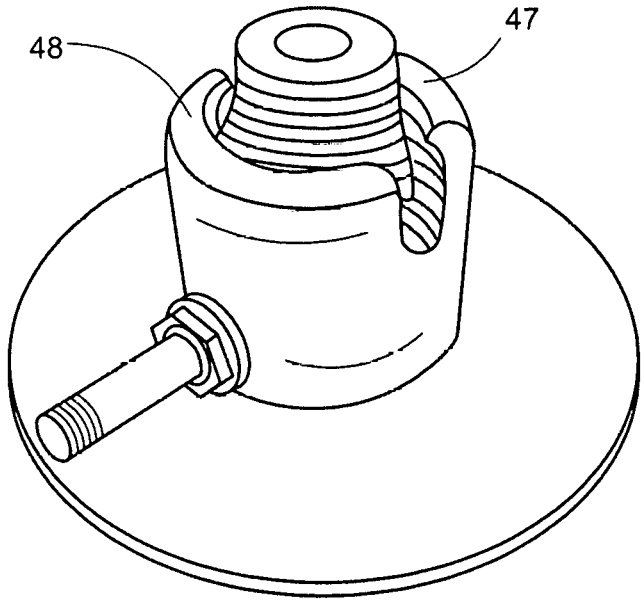
FIG. 19 is a perspective view of the present invention showing an enlarged tapered O-ring seal.

Referring now to FIG. 7, a simplified embodiment or apparatus 800 is shown, including body 120, first valve 160, and port 510. As an example, the body can be formed as a threaded cap with an O-ring for a bottle with a port to receive the bottle. Within the cap are threads in this embodiment. Further, the mouth of the bottle would have mating threads. By having a male to female threaded interaction, the bottle is able to be screwed into the port. Once the bottle is screwed into the port, an air-tight seal is formed. The first valve is mounted to the body. This embodiment is similar to a portion of the embodiment described in FIG. 1 but, as shown here, the port does not have a base. Air can be injected from an injector assembly shown in FIG. 5 or directly from a pump into valve 160. The injector assembly may have a pressure gauge, as shown in FIGS. 4 and 5. Once the bottle is properly pressurized, air is prevented from escaping through a check valve system as previously described. Then the bottle can be attached to a separate base or target system to hold the bottle in place while it is pressurized until it is shot and popped. This embodiment includes the same features of the embodiments described previously.

Examples of suitable target containers are now discussed A typical thin-walled 500 ml plastic bottle is preferred for air gun target practice. Such bottles may have a bursting pressure of approximately 70 PSI and will generate an explosive decompression at a pressure above about 55 PSI when struck by a pellet or other projectile. In order to ensure that these bottles do not prematurely explode, a pressure relief valve, if employed, would be set at about 65 PSI.

It is preferred that the thicker-walled one and two-liter plastic bottle be employed as the targets for firearm and archery (including crossbow) practice. These bottles typically have a bursting pressure of about 140 PSI. The pressure relief valve for such bottles would likely be set at approximately 105 PSI. The pressure to obtain explosive decomposition for these thicker-walled bottles is about 95 PSI.

It should be understood that the above parameters are provided as examples only and could be varied by the user as desired. As a further alternative, a pressure gauge can be employed directly with the FIGS. 1-3 embodiments, or it may be part of the compressed air supply apparatus. Threads in target bottles can be engaged with mating threads on any mounting or nipple 210 in any of the described embodiments, and not just in the FIGS. 4, 6, and 7 embodiments.

The body 120 can be formed as a cylindrical head 11 having a threaded adapter 12 formed on the cylindrical head 11. The cylindrical head 11 can be made of aluminum such as a billet aluminum of a cylindrical shape such as a cylindrical rod. Preferably, the cylindrical head 11 has a socket with the threaded adapter 12 that receives a water bottle target. The threaded adapter 12 includes an adapter inside bevel 17 that is formed on an inside edge of the adapter upper rim 19. On an outside edge of the adapter upper rim 19 is an adapter outside bevel 18. The adapter outside bevel 18 is preferably rounded with a radius of curvature. The socket has an adapter base with an adapter base depression 20. The adapter-based depression 20 receives an inset valve stem such that a valve stem upper surface of the inset valve stem is at a lower level than the adapter base.

The adapter of the socket has an adapter's first slot 13 and an adapter second slot 14. The first slot 13 and the second slot 14 are vertically oriented beginning from an upper edge of the adapter upper rim 19 and extending downward to an adapter slot rounded profile 16. The adapter slot rounded profile 16 is formed as a saddle shaped depression having a radius of curvature that matches the width of the slot, such as one half of the width of the slot.

The cylindrical head also has an access slot underneath the socket. A valve stem lower protrusion 22 extends downwardly into the valve stem access slot 23. The valve stem access slot 23 is bounded between a pair of valve stem access slot walls 24. The pair of valve stem access slot walls 24 extend between a pair of valve stem access slot edges 25. The valve stem access slot 23 can be milled out of a billet aluminum such that it has a rectangular profile when viewed from a side of the valve stem access slot 23.

The valve stem 28 is mounted between an adapter upper surface 33 and an adapter lower surface 26. The valve stem 28 can be tightened to the adapter lower surface 26 by a valve nut 27. The valve stem 28 can be threaded so that it engages the cylindrical head 11. The valve stem 28 optionally includes a valve stem wrench tool 30 that has a pair of valve stem wrench tool prongs 31 defined on a left and right side of a valve stem wrench tool slot 32. The valve stem wrench tool 30 can be removed from the valve stem 28 and then used for changing the one-way valve that is located a tip of the valve stem 28. The valve stem 28 has an air passage 43 through its middle portion such that the valve stem 28 is formed as a tubular straw having a one-way valve disposed at its tip.

The valve stem access slot 23 has sufficient clearance for a user to access the valve stem 28. The valve stem access slot 23 extends downwardly to a front access slot tip 34 and a rear access slot tip 35. The front access slot tip 34 and the rear access slot tip 35 have an arc shaped profile with rounded outer edges that engage the base 110. The base 110 has an outside base edge 111 that is normal to an upper and lower surface of the base 110. The base 110 also includes an inside base edge 112. The valve stem access slot 23 forms a front access slot overhang 36 and a rear access slot overhang 37. The front access slot overhang 36 and the rear access slot overhang 37 are both an exposed portion of the adapter valve lower surface 26, where the valve stem access slot edge 25 extends above an inside base edge 112 of the base 110. The base 110 can connect to the front access slot tip 34 and the rear access slot tip 35 when a base connection notch 53 is formed on an outside surface of the front access slot tip 34 and the rear access slot tip 35.

The front and rear access slot tip corners engage a ground surface such as when the apparatus is placed on grass or dirt. The front access slot tip has a front access slot tip right corner 54 and a front access slot tip left corner 55. The rear access slot tip has a rear access slot tip right corner 56 and a rear access slot tip left corner 57.

A seal can be formed as an O-ring seal, and the O-ring seal can be formed as a nipple which can be formed as a tapered plug. The seal is mounted to the port 510 and the port can be formed as a threaded adapter. The threaded adapter can have adapter slots 13, 14 formed on sidewalls of the threaded adapter so that the threaded adapter has this continuous internal threads. The adapter slots 13, 14 are preferably wider than a side wall thickness of the adapter. The water bottle target preferably seals against an O-ring seal 50. The O-ring seal 50 can be retained within a recessed groove such as an O-ring groove 51 formed on the adapter upper surface 33. The O-ring seal 50 is preferably sized to engage an inside surface of the water bottle neck. The O-ring can be formed as a tapered plug 40. The tapered plug 40 preferably has an outside taper 41 for engaging the inside surface of the water bottle neck at an angle. The tapered plug 40 has a tapered plug opening 42 disposed within the tapered plug 40.

The plug opening 42 communicates with the air passage 43 so that air can be pumped through the valve stem 28 of the Schrader valve to the air duct 44 and out of the center hole of the port 510. The optional tube extension 45 can be formed as a vertical metal tube rigidly mounted to the cylindrical head 11 at the adapter upper surface 33. The tube extension 45 extends upwardly from the adapter upper surface 33 and can be threaded to the adapter upper surface 33. The tapered plug 40 or an O-ring 50 having a circular cross-section can fit snugly to the tube extension 45 so as to provide an airtight seal when the target bottle 710 is secured to the adapter between the adapter slots 13, 14. Alternatively, the tube extension 45 can be a liner tube fitted inside the tapered plug 40 and not rigidly connected to the adapter upper surface 33, so that the tapered plug 40 can be more easily removed from the adapter.

While the present apparatus has been described in connection with what is considered a practical embodiment, it is to be understood that the apparatus is not to be limited to the disclosed arrangements, but is intended to cover various arrangements which are included within the spirit and scope of the appended claims so as to encompass all modifications and equivalent arrangements that are possible.

The invention claimed is:

1. A shooting target apparatus comprising: a base; a body connected to the base; an inlet valve connected to the body and adapted to be connected to a source of pressurized fluid, wherein the first valve provides for a one-way intake of fluid; a socket formed on the body, wherein the socket is formed as a threaded adapter having sidewalls, wherein the threaded adapter has an adapter upper surface; a seal mounted to the adapter upper surface, wherein the body and the seal include a pathway therein formed to channel fluid between the first valve and the seal, the threaded adapter being shaped and configured to removably receive a target; a first target holder attached to the body, wherein the first target holder is configured to selectively engage a target, wherein the first target holder is a threaded adapter first section; a second target holder attached to the body, wherein the second target holder is configured to selectively engage a target, wherein the second target holder is a threaded adapter second section; and a first adapter slot and a second adapter slot formed on the threaded adapter, wherein the first adapter slot opposes the second adapter slot, wherein the first adapter slot and the second adapter slot extend from an adapter upper rim downward, wherein threads of the threaded adapter are discontinuous.

2. The shooting target apparatus of claim 1, wherein the threaded adapter has an adapter lower surface, wherein the inlet valve is mounted to an adapter lower surface, wherein the inlet valve is formed with a valve stem.

3. The shooting target apparatus of claim 2, wherein the adapter lower surface is formed inside a valve stem access slot, wherein the valve stem access slot is formed between a pair of valve stem access slot walls, wherein the valve stem access slot further defines a front access slot tip and a rear access slot tip extending downwardly from the valve stem access slot.

4. The shooting target apparatus of claim 3, wherein the valve stem access slot has a front access slot overhang and a rear access slot overhang.

5. The shooting target apparatus of claim 3, wherein the valve stem is secured to the adapter lower surface by a valve nut.

6. The shooting target apparatus of claim 3, wherein the valve stem is mounted between the pair of valve stem access slot walls.

7. The shooting target apparatus of claim 3, wherein the adapter lower surface has an adapter base depression formed between the threaded adapter first section and the threaded adapter second section, and wherein the adapter-based depression is formed between the first adapter slot and the second adapter slot.

8. The shooting target apparatus of claim 3, wherein the front access slot tip and the rear access slot tip are configured to support the shooting target apparatus, wherein the front access slot tip has a front access slot tip right corner and a front access slot tip left corner, wherein the rear access slot tip has a rear access slot tip right corner and a rear access slot tip left corner, wherein the front access slot tip right corner, the front access slot tip left corner, the rear access slot tip right corner and the rear access slot tip left corner are all configured to support the shooting target apparatus by extending downwardly from the body.

9. The shooting target apparatus of claim 8, wherein the valve stem access slot has a front access slot overhang and a rear access slot overhang.

10. The shooting target apparatus of claim 8, wherein the valve stem is secured to the adapter lower surface by a valve nut.

11. The shooting target apparatus of claim 8, wherein the valve stem is mounted between the pair of valve stem access slot walls.

12. The shooting target apparatus of claim 8, wherein the adapter lower surface has an adapter base depression formed between the threaded adapter first section and the threaded adapter second section, and wherein the adapter-based depression is formed between the first adapter slot and the second adapter slot.

13. The shooting target apparatus of claim 12, wherein the valve stem access slot has a front access slot overhang and a rear access slot overhang.

14. The shooting target apparatus of claim 12, wherein the valve stem is secured to the adapter lower surface by a valve nut.

15. The shooting target apparatus of claim 14, wherein the valve stem access slot has a front access slot overhang and a rear access slot overhang.

* * * * *